United States Patent [19]

Lin

[11] Patent Number: 4,936,788

[45] Date of Patent: Jun. 26, 1990

[54] ELECTRICAL CONNECTOR

[75] Inventor: Ling-Yung Lin, Taipei, Taiwan

[73] Assignee: New Chien Lung Ent. Co., Ltd., Taipei, Taiwan

[21] Appl. No.: 362,111

[22] Filed: Jun. 6, 1989

[51] Int. Cl.[5] ..... H01R 27/00

[52] U.S. Cl. ..... 439/218; 439/699; 439/541

[58] Field of Search ..... 439/699, 619, 675, 668, 439/669, 638–640, 645, 646, 375, 379, 502, 650, 651, 930, 218, 541

[56] References Cited

U.S. PATENT DOCUMENTS

| | | | |
|---|---|---|---|
| 2,713,671 | 7/1955 | Hunt | 439/638 |
| 3,135,571 | 6/1964 | Klinkwitz | 439/825 |
| 4,100,448 | 7/1978 | Chipner et al. | 439/699 |
| 4,544,218 | 10/1985 | Sanders et al. | 439/650 |

FOREIGN PATENT DOCUMENTS

| | | | |
|---|---|---|---|
| 816765 | 8/1937 | France | 439/699 |
| 858692 | 1/1961 | United Kingdom | 439/699 |

*Primary Examiner*—David Pirlot

*Attorney, Agent, or Firm*—Browdy and Neimark

[57] ABSTRACT

The present disclosure is related to an improved connector for use in electrical ornamental articles mainly disposed on Christmas trees or the like, which has an integrally formed plastic shell made by injection molding with three consecutive sections, the first thereof being in trapezoid form, and the second and third being of cylindrical shape with different size. The tapered sides of the trapezoid section permit easy attachment of the connector to a socket; on the external wall of the second section are disposed a plurality of spaced collapsible ribs in the axial direction. Metallic contacts are removably placed in a pair of divided tunnels of the connector with the front ends thereof extended out of the connector and reversely bent in abutment against the external wall of the first section.

2 Claims, 3 Drawing Sheets

ELECTRICAL CONNECTOR

FIELD OF THE INVENTION

The present invention relates to an improved connector adapted for use in electrical ornamental articles mainly disposed on Christmas trees or the like. The connector has a plastic shell integrally formed by injection molding with a pair of divided tunnels defined therein for the passage of a pair of metallic contacts in assembly. The shell of the present invention has 3 consecutive sections, the first being of symmetric trapezoid form and the second and the third being of cylindrical shape with the second smaller the third. The first symmetric trapezoid section is defined to have tapered sides, and a plurality of spaced collapsible ribs are disposed in the axial direction on the external wall of the second section thereof so that the connector can be firmly fitted into sockets of different size.

Traditionally, Christmas has been celebrated by most of the families in Western countries, and it is indispensible for them to acquire Christmas trees each year and decorate the same with bright and shining ornamental articles most of which are electrically actuated. To couple these articles to electrical power sources, several kinds of connector have been available on the international markets.

It has always been a problem to associate sockets of these ornamental articles with connectors of different types as a result of various sizes thereof. There has been no standard form for the connectors and sockets, to fit connectors and sockets of different types together has been disclosed in a number of prior art patents.

DESCRIPTION OF THE PRIOR ART

In the U.S. Pat. No. 4,544,218 Sanders et al disclosed an improved connector equipped with a detachable support member of insulating material, in the support member being placed part of bendable metallic contacts extended from a base element; thus to form a separable plug connector. This type of connector can be properly modified to fit in sockets of various size by simply replacing the original support member of the ornamental articles with the support member of a light lamp inserted in the socket of a light string.

However, there are still a number of disadvantages in the '218 patent cited as follows:

1. To change the support member from the lamps to ornamental articles in large quantity is time consuming and boring.
2. The frequent replacement of the support members between the ornamental articles and the lamps of a light string makes the bendable metallic contacts easily broken and render either the ornamental article or the lamp useless.
3. The production speed is limited by the injection molding process wherein the metallic contacts must be located in a mold in order, most by human labor.

To overcome the above cited problems, the present inventor disclosed an improved electrical connector in his U.S. pending patent application Ser. No. 288,261, filed on Dec. 22, 1988. This improved connector has been produced and used in a rather satisfactory manner, but the production speed thereof is also limited by the injection molding machines. Therefore, it is impossible to produce in large quantity the above cited connector at a small scale factory.

The intention to increase the production speed thereof made the present inventor design another improved electrical connector which can be produced at least as 15 times as fast as the methods disclosed in Sander's '218 patent and the present inventor's previous U.S. pending application.

SUMMARY OF THE INVENTION

Therefore, the primary object of the present invention is to provide an improved connector made in an integral form and adapted for readily fitting in various types of electrical sockets of ornamental articles disposed on a Christmas tree or the like.

One other object of the present invention is to provide an improved electrical connector which is integrally formed to have a 3-section plastic shell having two longitudinal tunnels defined therein divided by an insulating wall so that a pair of metallic contacts can be guided passing therethrough with the frontmost end of the contacts extending out of the plastic shell and bent reversely and fixed in place.

One still further object of the present invention is to provide an improved electrical connector provided with a 3-section plastic shell, the second and third consecutive sections thereof being of cylindrical shape and having an increased diameter, and the first section thereof being made in a symmetric trapezoid shape. The sides of the first trapezoid section are defined in tapered manner so that the connector can be readily fitted in a socket.

One still further object of the present invention is to provide an improved electrical connector having a 3-section plastic shell, on the external wall of the second section, in the axial direction, there are disposed a plurality of spaced collapsible ribs so that the connector can be firmly plugged in sockets of different size.

To better illustrate the structure and operation modes and features of the present invention, a number of drawings are presented along with a detailed description of a preferred embodiment of the present invention, in which:

DETAILED DESCRIPTION OF PREFERRED EMBODIMENT

Figure 1:
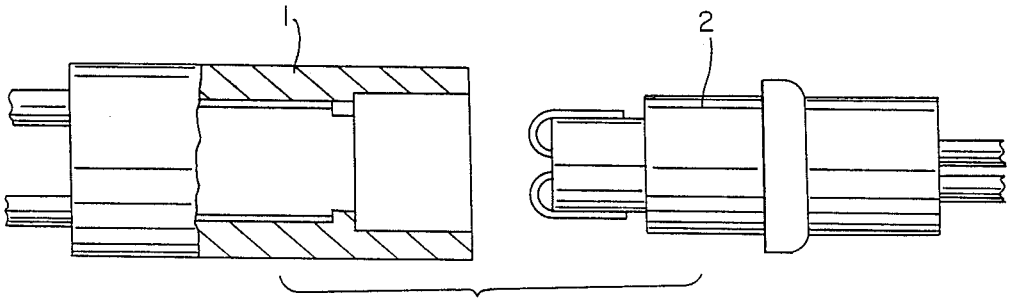
FIG. 1 PRIOR ART
FIG. 1 is a diagram showing a socket and an electrical connector of Sander's '218 U.S. patent.
Figure 2:
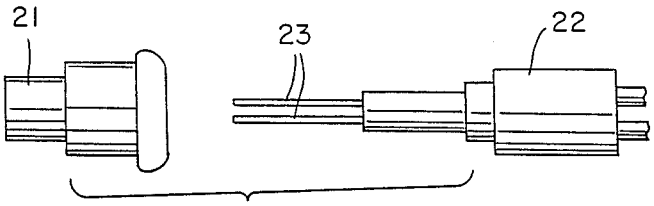
FIG. 2 PRIOR ART
FIG. 2 is a diagram showing the separation of Sander's connector.
Figure 3:
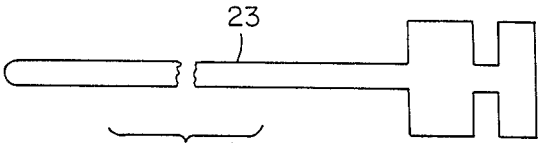
FIG. 3 PRIOR ART
FIG. 3 is a diagram showing the structure of a typical metallic contact.
Figure 4:
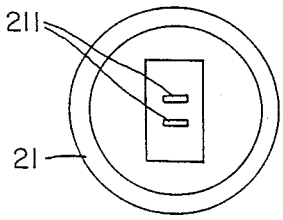
FIG. 4 PRIOR ART
FIG. 4 is a diagram showing the top view of the prior art support members.

Referring to FIG. 1, in Sander's U.S. '218 patent, a socket 1 is engageable with a connector 2. That improved connector consists of, as shown in FIG. 2, a replaceable support member 21, and a base element 22 equipped with embedded metallic contacts 23 which have their front ends 23 extended outward so that they can penetrate through two holes 211 of the support member 21 and bent reversely in assembly as shown in FIG. 1.

The metallic contact 23 of the prior art is also adopted in the present invention, which is engaged with an electrical cord at the rear end thereof first, then a pair of the metallic contacts 23 are placed in order in an injection molding device for further process, resulting in the formation of the base element 22.

The major problem with the prior art is that the production speed is limited by the process of properly locating the metallic contacts in a molding device for further process. In most small-scale factories, automatic machines are not so popular, therefore, the production speed is often bottle-necked by the process.

Figure 5:
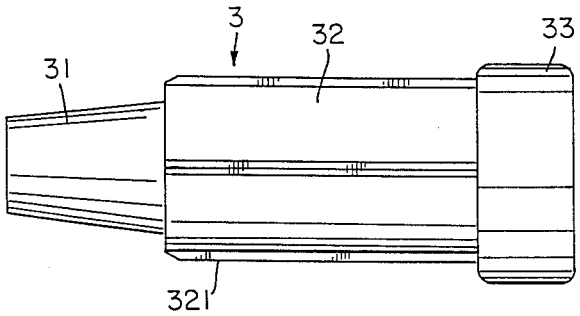
FIG. 5 is a side view of the plastic shell of the present invention.
Figure 7:
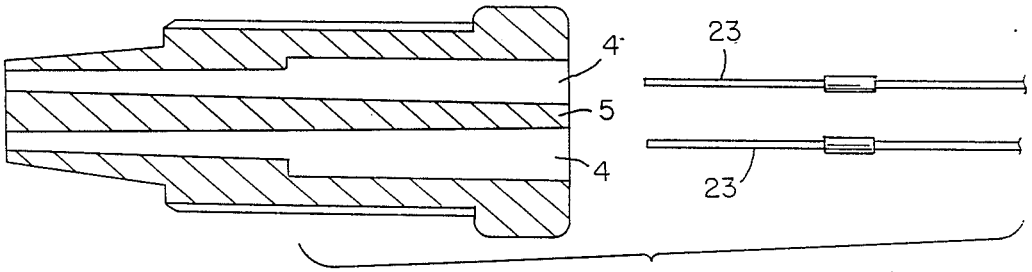
FIG. 7 is a longitudinal cross sectional view of the plastic shell.
Figure 8:
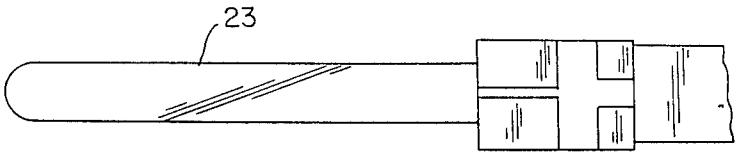
FIG. 8 is a diagram showing the metallic contact disposed in the present plastic shell.
Figure 9:
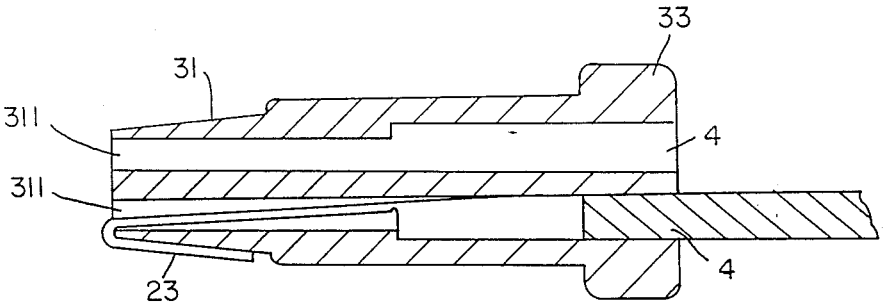
FIG. 9 is a cross sectional view of the present connector.
Figure 10:
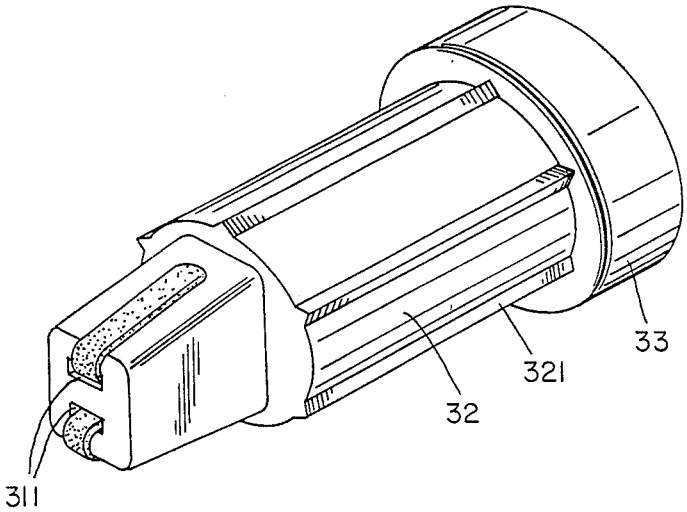
FIG. 10 is perspective view of the present connector.

To solve the problem, the present connector adopts a plastic shell 3 integrally formed by may of injection molding process. The plastic shell 3 has three consecutive sections 31, 32, 33, as shown in FIG. 5. The interior of the plastic shell 3 is provided with a pair of parallel tunnels in axial direction and divided by an insulating wall 5, as shown in FIG. 7. The metallic contacts 23 of the prior art are engaged with electrical cords and placed through the tunnels 4 respectively, as shown in FIG. 9, with the front ends thereof extended beyond the tip of the plastic shell 3 through two holes 311 thereat and bent reversely to abut against the outer walls of the first section 31.

Figure 6:
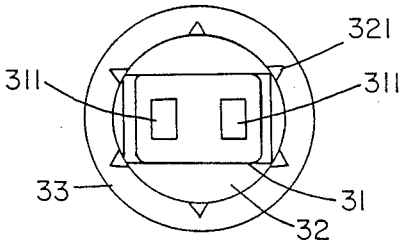
FIG. 6 is a top view of the plastic shell of the present invention.

Referring to FIG. 5 and FIG. 6, the 3-section plastic shell 3 consisting of a first section 31 of symmetric trapezoid shape and a second and third sections 32, 33 of cylindrical form. The second and third sections 32, 33 are designed to have different diameters with the second section smaller than the third. The sides of the first sections 31 are defined to have tapered sides so as to permit the plastic shell 3 to be inserted in a socket with ease.

On the external wall of the second section 32, there are disposed a plurality of spaced parallel collapsible ribs 321, thereby the plastic shell 3 can be tightly fitted in sockets of different size.

It can be clearly seen that the present invention combines integrally the support member and the base element of the prior art together by means of a 3-section plastic shell which is removably associated with a pair of metallic contacts housed therein and guided therethrough in assembly with the front ends thereof extended over the plastic shell and reversely bent to abut against the outer wall of the first section. To enable the plastic shell firmly fit in sockets of different size, a plurality of spaced collapsible ribs are disposed on the outer wall of the second section of the plastic shell, which are able to be tightly engaged with the inner wall of the socket wherein the shell is located.

The major feature of the present invention lies in that the integral plastic shell is detachably engaged with the electrical contacts by human labor so that there is no need to place the electrical contacts in pair by a worker in an injection molding to produce the base element of the U.S. '218 patent of Sanders et al. This approach can not only increase the production speed at least 15 times, but also the bad products, resulting from improper arrangement of the electrical contacts in the injection molding, can be totally avoided.

What I claim is:

1. An improved electrical connector adapted for use in electrically acutated ornamental articles disposed mainly on Christmas trees comprising a three-section plastic shell integrally formed in consecutive manner by injection molding, the first section thereof being defined in a symmetric trapezoid shape and the second and the third sections being of cylindrical form with the diameter of the second section being smaller than the diameter of the third section; an interior of said plastic shell being provided with a pair of longitudinal tunnels divided by an insulating wall, and a pair of through holes being disposed on the end of said first section at the terminal of said tunnels so that a pair of metallic contacts can be removably engaged with said plastic shell with the front ends thereof extended over the first section of said shell and reversely bent to abut against the outer wall thereof; a plurality of longitudinal spaced collapsible ribs being disposed on the outer wall of the second section of said plastic shell thereby the connector can be tightly fitted in sockets of various size.

2. An improved electrical connector as claimed in claim 1 wherein the sides of said symmetrical trapezoid first section are defined in tapered form so that the connector can be readily fitted in sockets of various size and firmly engaged in said socket with the help of said collapsible ribs on said second section.

* * * * *